United States Patent [19]

Mullin et al.

[11] Patent Number: 4,624,245

[45] Date of Patent: Nov. 25, 1986

[54] HIP DISPLACEMENT APPARATUS

[76] Inventors: Robert J. Mullin, 19711 Seppo St., Chatsworth, Calif. 91711; Donald M. O'Sullivan, 2323 Union Ave., Westleyville, Pa. 16510

[21] Appl. No.: 639,462

[22] Filed: Aug. 10, 1984

[51] Int. Cl.[4] ..... A61G 13/00

[52] U.S. Cl. ..... 128/75; 128/69; 269/328

[58] Field of Search ..... 128/69, 71, 75; 269/322, 328

[56] References Cited

U.S. PATENT DOCUMENTS

| | | | |
|---|---|---|---|
| 1,516,795 | 11/1924 | Schwarting | 269/328 |
| 2,306,031 | 12/1942 | Anderson | 269/323 |
| 2,470,026 | 5/1949 | Freund | 269/328 |
| 2,678,857 | 5/1954 | Hans | 269/328 |
| 3,389,702 | 6/1968 | Kennedy | 269/328 |
| 3,823,709 | 7/1974 | McGuire | 269/328 |
| 4,180,254 | 12/1979 | Lee | 269/328 |
| 4,257,410 | 3/1981 | Flewelling | 128/75 |
| 4,392,645 | 7/1983 | Westphal | 269/328 |
| 4,407,277 | 10/1983 | Ellison | 269/328 |
| 4,443,005 | 4/1984 | Sugarman | 269/328 |
| 4,526,355 | 7/1985 | Moore | 269/328 |
| 4,527,555 | 7/1985 | Ruf | 269/322 |

*Primary Examiner*—Clifford D. Crowder

[57] ABSTRACT

A device for laterally displacing a femur from a hip socket is provided which includes a mount for attachment to a stationary surface, such as a surgical table, a member for exerting pressure against the femur when the member is placed in a predetermined position in contact with the patient, and an assembly for moving the member relative to the mount. Movement of the member permits a sufficient amount of pressure to be exerted and maintained against the femur to laterally displace it from the hip socket. The assembly includes a carriage adapted for selective angular attachment to the mount, a guide movably connected to the carriage and a lead screw for moving the guide relative to the carriage. The member is connected to, and movable with, the guide.

2 Claims, 5 Drawing Figures

HIP DISPLACEMENT APPARATUS

BACKGROUND OF THE INVENTION

1. Field of the Invention

The present invention relates to orthopedic surgical devices and, more particularly, to devices for laterally displacing skeletal members during surgery.

2. Description of the Prior Art

In order to satisfactorily perform some orthopedic surgical procedures, it is necessary to temporarily displace one skeletal member from its position relative to another skeletal member. During a total hip replacement, for example, the head of the femur must be displaced from the hip socket. There are currently no mechanical means for displacing a femur from a hip. There is a need, therefore, for a device which can be used during surgery to temporarily laterally displace one skeletal member from its normal position of engagement with another skeletal member.

Accordingly, it is an object of the present invention to provide such a device which can be provided as an accessory to available surgical or orthopedic tables or which can be an integral part of a table. It is a further object of the present invention to provide such a device which can be longitudinally and angularly adjusted to accommodate a range of patient positions.

SUMMARY OF THE INVENTION

The present invention provides a device for laterally displacing a patient's first skeletal member, such as a femur, from its normal position of engagement with a second skeletal member, such as a hip. The device is for use with a stationary surface, such as a surgical table.

The device includes a mount for attachment to the stationary surface, a member for exerting pressure against the first skeletal member when the member is placed in a predetermined position in contact with the patient, and an assembly for so moving the member relative to the mount that a sufficient amount of pressure can be selectively exerted and maintained against the first skeletal member to laterally displace the first skeletal member from its normal position of engagement with the second skeletal member. The mount may be releasably attached to the stationary surface. Alternatively, the mount may be integral to the stationary surface.

The assembly preferably includes a carriage which is adapted for such selective angular attachment to the mount that the member can be moved at a predetermined angle relative to the mount. The assembly also includes a guide which is movably connected to the carriage and has the member so mounted thereon that movement of the guide relative to the carriage moves the member at the predetermined angle relative to the mount. Means, such as a lead screw, for moving the guide relative to the carriage are also included in the assembly.

The lead screw may be so threadably associated with the carriage and so connected to the guide that rotation of the lead screw moves the guide relative to the carriage. Means for rotating the lead screw, such as a handle, may be provided.

Means for mounting the member to the guide may also be included in the assembly. The mounting means is preferably adapted for extension relative to the guide.

BRIEF DESCRIPTION OF THE DRAWINGS

The following detailed description of the preferred embodiment can be better understood if reference is made to the attached drawings in which.

DETAILED DESCRIPTION OF THE PREFERRED EMBODIMENT

Figure 1:
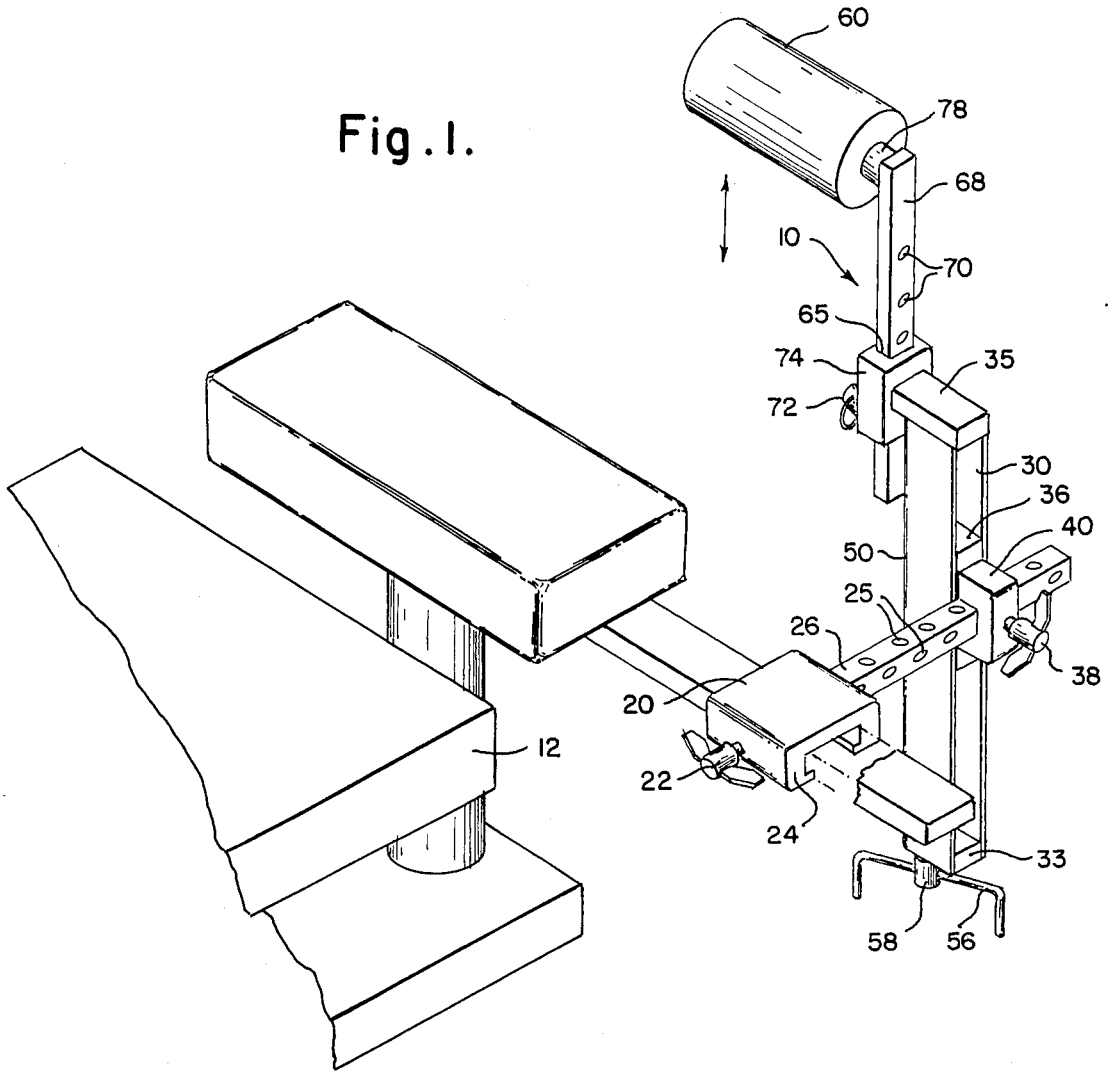
FIG. 1 is a fragmentary isometric view of the table and the device of the present invention oriented to accommodate a patient in the lateral position.

FIGS. 1 through 5 illustrate the preferred embodiment of the displacement device 10 of the present invention.

The displacement device 10 is intended for use with a stationary surface, such as a surgical or orthopedic table 12. The device 10 may be provided as a separate accessory to the table or may be an integral part of the table.

The displacement device 10 includes a mount 20, a member 60 for applying pressure against the patient and an assembly 30 for moving the member 60 relative to the mount 20. The preferred use of the device 10 is for displacing the head of the patient's femur from the hip-socket for a desired period during a surgical procedure, such as a total hip replacement, to provide the surgeon room in which to work.

When the device 10 is provided as a separate accessory, mount 20 preferably includes a clamp 24 for attachment to the table 12, a wing screw 22, or some other suitable known element, for tightening the clamp 24 to the table 12, and a square bar 26 on which assembly 30 is attached. Wing screw 22 includes threaded end 23 (FIG. 5) which is inserted into threaded recess 28 of clamp 24 to tighten the clamp.

Figure 2:
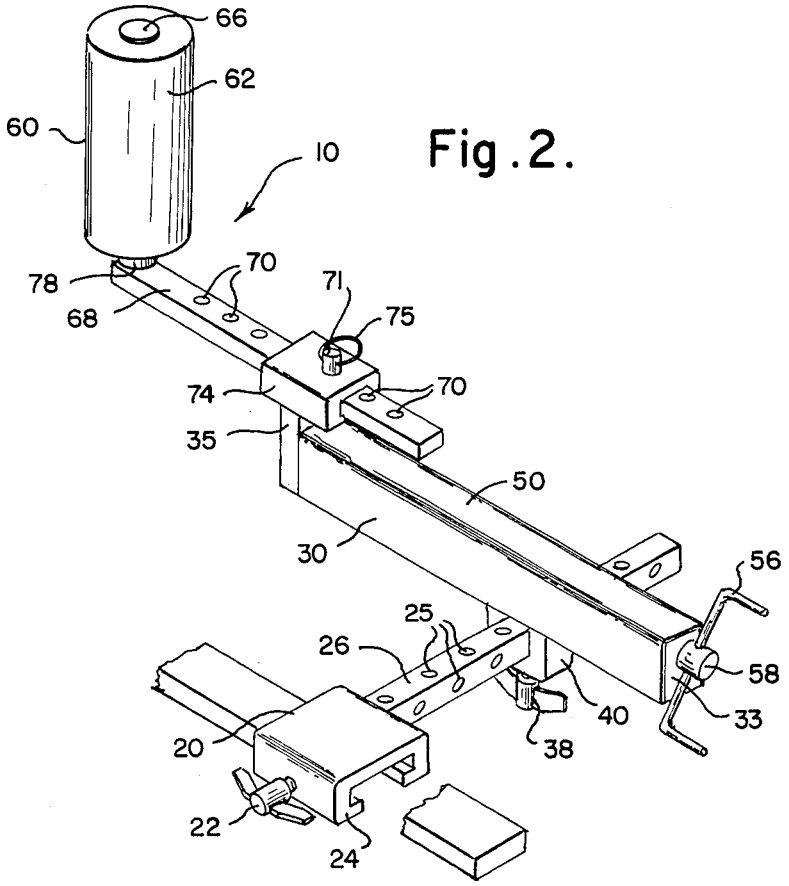
FIG. 2 is an isometric view of the device of FIG. 1 oriented to accommodate a patient in the supine position.
Figure 5:
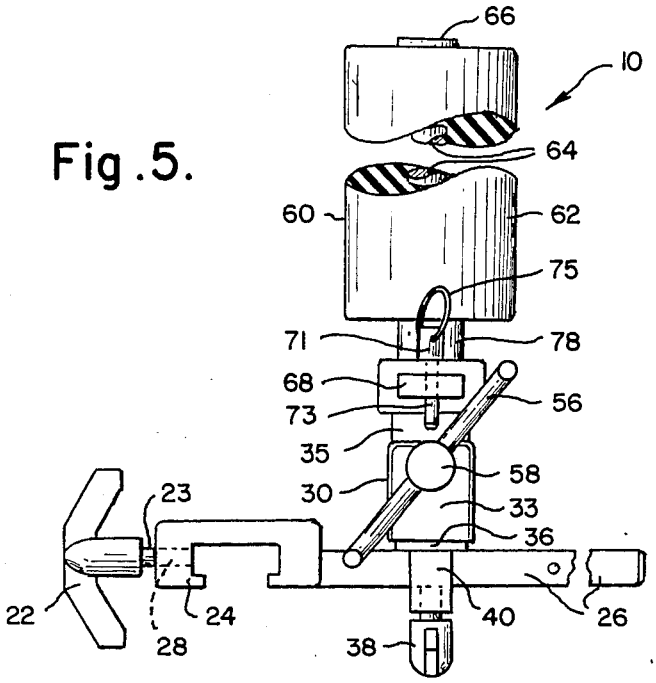
FIG. 5 is an end elevational view of the device shown in FIG. 3 viewed from the left.
Figure 3:
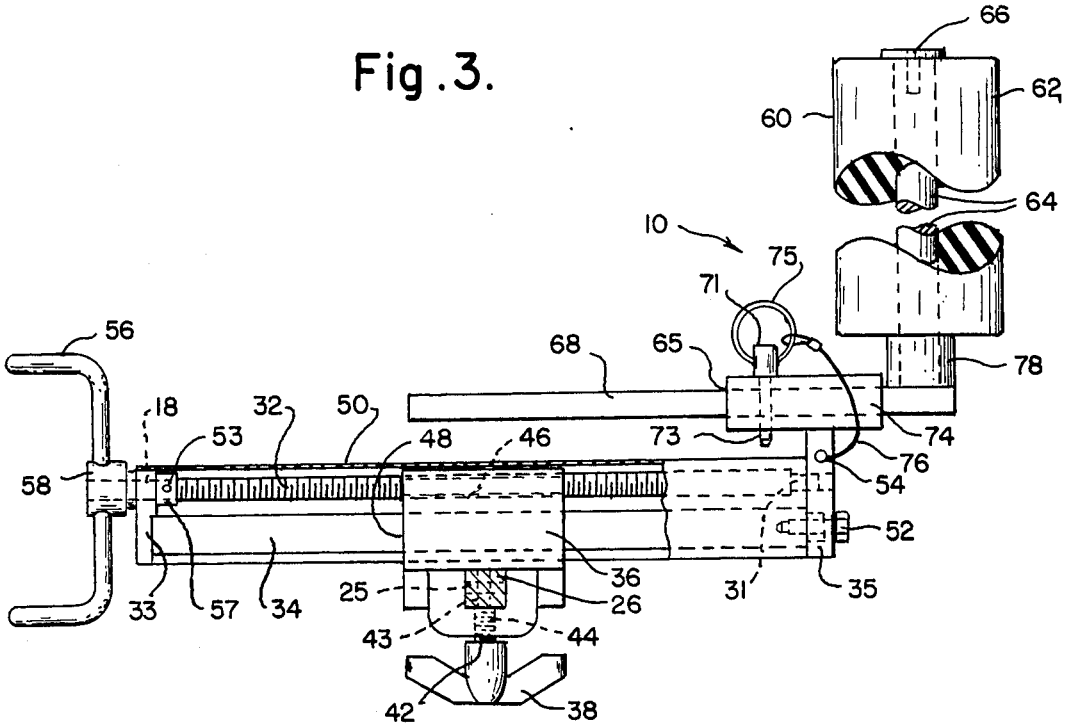
FIG. 3 is a side elevational view of the device shown in FIG.1.
Figure 4:
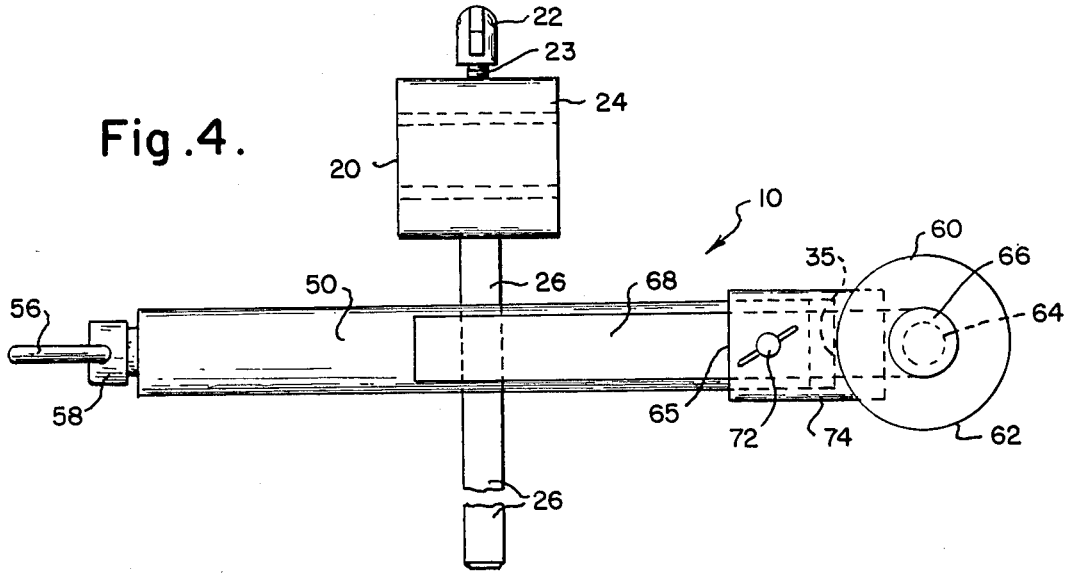
FIG. 4 is a top plan view of the device as shown in FIG. 3.

Assembly 30 includes clamp 40 and wing screw 38 for attaching assembly 30 to square bar 26. Clamp 40 can be positioned on any side of square bar 26, thereby permitting the selective angular attachment of assembly 30 to mount 20 so that member 60 can be moved at a predetermined angle relative to mount 20. FIGS. 1 and 2 illustrate two possible orientations which permit the device 10 to be used when the patient is in a lateral position or a supine position, respectively.

Wing screw 38 includes threaded end 42 (FIG. 3) and pin 43 which are inserted into recess 44 of clamp 40 and one of the holes 25 of square bar 26 to lock clamp 40 into position on square bar 26. Square bar 26 is provided with a plurality of holes 25 to receive pin 43 along the length of any side of square bar 26. Assembly 30 can be attached anywhere along the length of square bar 26 to further aid in providing the desired orientation of member 60.

When device 10 is provided as an integral part of table 12, clamp 24 and wing screw 22 may be eliminated. Assembly 30 may be mounted on an integral square bar 26, or any suitable known structure which will permit the desired range of longitudinal and angular orientation of member 60. Clamp 40 and wing screw 38 of assembly 30 may also be replaced by suitable alternative elements which lock assembly 30 into the desired orientation.

Assembly 30 also includes lead screw 32, guide bar 34 and carriage 36. Lead screw 32 and guide bar 34 are held in a parallel spaced relationship relative to each other by brackets 33 and 35. They are enclosed in frame 50. Screws 54 hold frame 50 to brackets 33 and 35.

Carriage 36 includes threaded recess 46 through which lead screw 32 passes, and recess 48 through which guide bar 34 passes. Clamp 40 extends from carriage 36 as shown in FIG. 1 to attach the carriage 36 to square bar 26 of mount 20.

Lead screw 32 is connected to bracket 33 by any suitable known means, preferably by bushing 57 and a roll pin 53. An unthreaded portion 18 of lead screw 32 extends through bracket 33 into hub 58 of handle 56. Roll pins 53 connect the hub 58 to the unthreaded portion 18 of lead screw 32. A tapered end 31 of lead screw 32 extends into bracket 35.

Guide bar 34 is connected to bracket 35 by bolt 52 and to bracket 33 by means of a recess in bracket 33. Any suitable known means, however, such as welding, may be used to connect guide bar 34 to brackets 33 and 35.

Support 74 is mounted on an extended end of bracket 35 by any suitable known means. Support 74 has opening 65 through which the adjustable support bar 68 passes. Adjustable support bar 68 includes a plurality of holes 70 along its length into which the narrow portion 73 of a pin 72 may be inserted to lock adjustable support bar 68 into position on support 74.

Pin 72 includes head 71 and ring 75. Cable 76 is attached to ring 75 of pin 72 and to bracket 35 by a screw 54 to prevent the loss of pin 72.

Member 60 includes rod 64 surrounded by padding 62. Padding 62 may be made of any suitable material capable of cushioning the pressure exerted against the patient's thigh. Spacer 78 maintains padding 62 in a spaced relationship relative to adjustable support bar 68. Retainer screw 66 holds padding 62 in place on rod 64. Rod 64 extends perpendicularly from adjustable support bar 68 and may be extended relative to bracket 35 by placing adjustable support bar 68 in the desired position in support 74.

In operation, clamp 24 is mounted on the appropriate position of table 12, and locked into position by tightening wing screw 22. Clamp 40 is positioned on square bar 26 at the desired, predetermined angle and locked into position by inserting pin 43 of wing screw 38 into the appropriate hole 25 and tightening wing screw 38 by turning threaded end 42 into recess 44 of clamp 40. Carriage 36 is firmly locked into a stationary position.

Handle 56 turns lead screw 32, moving it and guide bar 34 through carriage 36. By means of the attachment to support 74 and bracket 35, member 60 moves with lead screw 32 and guide bar 34 at the desired angle relative to the mount 20. Extension of adjustable support bar 68 through support 74 provides further extension of member 60 relative to assembly 30 and mount 20.

Padding 62 of member 60 is placed at an appropriate, predetermined position in contact with the patient's inner thigh. As lead screw 32 is turned to move guide 34 through carriage 36, padding 62 and rod 64 of member 60 exerts pressure against the femur. A sufficient amount of pressure can be selectively exerted and maintained against the femur to laterally displace the head of the femur from its normal position in the hip socket. When the surgeon completes the procedure, lead screw 32 can be turned in the opposite direction to move guide 34 and member 60 back to their initial positions, thereby gradually relieving the pressure exerted against the femur so that it can be returned to its normal position.

Although the preferred embodiment of device 10 is designed for use in the lateral displacement of the femur from the hip socket, it will be appreciated by those skilled in the art that the device 10 can be easily adapted for use with other skeletal members without exceeding the scope of the claimed invention.

What is claimed is:

1. A device of use with a stationary surface for laterally displacing a patient's femur from its normal position of engagement with the patient's hip comprising:

a mount for attachment to the stationary surface;

a member for exerting controlled pressure against the femur when said member is placed in a predetermined position in contact with the patient; and an assembly for so moving said member relative to said mount that a sufficient amount of controlled pressure can be selectively exerted and maintained against the femur to laterally displace the femur from its normal position of engagement with the hip and said assembly being structured for so moving said member that said pressure can be selectively diminished, said assembly being structured to permit said member to be moved for exerting controlled pressure against the femur to accommodate a plurality of patient orientations;

wherein said assembly comprises a carriage adapted for such selective angular attachment to said mount that said member can be moved at a predetermined angle relative to said mount;

a guide movably connected to said carriage and having said member so mounted thereon that movement of said guide relative to said carriage moves said member at said predetermined angle relative to said mount;

a lead screw so threadably associated with said carriage and so connected to said guide that rotation of said lead screw moves said guide relative to said carriage;

means for rotating said lead screw; and means for mounting said member to said guide, said mounting means being structured for extension relative to said guide.

2. A device as recited in claim 1 wherein said mount is integrally attached to the stationary surface.

* * * * *